US005096039A

United States Patent [19]

Abe

[11] Patent Number: 5,096,039

[45] Date of Patent: Mar. 17, 1992

[54] COIN INTERMITTENT ACCEPTING DEVICE

[75] Inventor: Hiroshi Abe, Tokyo, Japan

[73] Assignee: Asahi Seiko Kabushiki Kaisha, Tokyo, Japan

[21] Appl. No.: 664,213

[22] Filed: Mar. 4, 1991

[30] Foreign Application Priority Data

Mar. 9, 1990 [JP] Japan ..... 2-23185[U]

[51] Int. Cl.[5] ..... G07F 1/04

[52] U.S. Cl. ..... 194/346; 221/298; 379/152

[58] Field of Search ..... 194/346, 241, 242; 221/297, 298; 379/150, 151, 152

[56] References Cited

U.S. PATENT DOCUMENTS

| | | | |
|---|---|---|---|
| 2,691,484 | 10/1954 | Hoyt | 194/346 X |
| 2,869,755 | 1/1959 | Gaudreau | 221/297 X |
| 3,197,006 | 7/1965 | Rub et al. | 194/242 |
| 3,602,403 | 8/1971 | Klem | 221/293 |
| 4,399,902 | 8/1983 | Holland et al. | 194/346 |

*Primary Examiner*—F. J. Bartuska
*Attorney, Agent, or Firm*—Nilles & Nilles

[57] ABSTRACT

A coin intermittent accepting device of a reservation type coin acceptor including a coin reserving passage for temporarily reserving a plurality of coin as in public telephones. The accepting device includes an electromagnetic solenoid fixed on one of parallelly spaced side plates of said coin reserving passage, parallelly spaced support arms each having one end pivotably supported on a pivot axis extending perpendicular to the longitudinal axis of a plunger of the electromagnetic solenoid and other free ends integral with an acceptance gate, and a coin stop arm having one end pivotably supported on the pivot axis and other free end providing the coin stop, at least one of the support arms and the coin stop arm being provided with longitudinal slots inclined in opposite directions, respectively, and the plunger of the electromagnetic solenoid having at the free end thereof an actuating pin extending perpendicular to the longitudinal axis of the plunger and engaging the inclined slots.

3 Claims, 3 Drawing Sheets

COIN INTERMITTENT ACCEPTING DEVICE

BACKGROUND OF THE INVENTION

1. Field of the Invention

The present invention relates to a coin intermittent accepting device of a reservation type coin acceptor or the like which is a type capable of temporarily reserving a plurality of coin in a coin reserving passage for use in for example a public telephone.

2. Related Art Statement

A typical conventional reservation type coin acceptor includes a coin reserving passage 1 as shown in FIG. 1 for temporarily reserving a plurality of coins A, B and C which are inserted through a coin insertion slot and passed through means for discriminating a diameter, material and other characteristics of coin as shown by an arrow a. The coin reserving passage 1 is provided at an outlet end 2 with an acceptance gate 3 and a return gate 4 and additionally provided at the upstream side of the outlet end 2 with a retractable coin stop 5.

The acceptance gate 3 and the coin stop 5 are actuated between their open and close positions by individual electromagnetic solenoids 6 and 7, respectively in order to intermittently accept the reserved coins from the reserving passage 1 into an acceptance passage 8 one at a time. The acceptance gate actuating electromagnetic solenoid 6 and coin stop actuating electromagnetic solenoid 7 are correlatively sequently operated when the reserved coin A is accepted from the reserving passage 1 while the return gate 4 is closed such that firstly the coin stop solenoid 7 is energized to protrude the coin stop 5 into the reserving passage 1 and then the acceptance gate solenoid 6 is energized to open the acceptance gate 3 in order to assure to pass only one reserved coin A to the acceptance passage 8 as shown by an arrow b and prevent the following reserved coins B and C form passing through the outlet end 2 into the acceptance passage 8. After the leading coin A is thus accepted, the electromagnetic solenoids 6 is dienergized to close the acceptance gate 3 and then the electromagnetic solenoid 7 is dienergized to withdraw the coin stop 5 out of the reserving passage 1 to thereby advance the following reserved coin B to the outlet end 2 and retain it by the acceptance gate 3 and the return gate 4 which are in their closed positions.

It should be noted that the return gate 4 may be actuated to its open position by means of a separate electromagnetic solenoid (not shown) or a conventional coin return lever mechanism to return reserved coins in the reserving passage 1 through a return passage 9 as shown by an arrow c.

Such a conventional arrangement for intermittently accepting reserved coins from the reserving passage to the acceptance passage needs two electromagnetic solenoids 6 and 7 for individually actuating the acceptance gate 3 and the coin stop 5 and further a complicated electric control system for control the two electromagnetic solenoids so as to correlatively and sequently actuate the acceptance gate and the coin stop as a result the coin acceptor becomes complicate and large as the whole as well as expensive.

SUMMARY OF THE INVENTION

An object of the present invention is to remove the aforementioned disadvantages by providing a mechanical coin intermittent accepting device including the acceptance gate and coin stop which can be actuated by single electromagnetic solenoid without aforementioned complicate electric control system to provide a reservation type coin acceptor in a small size and light weight with a reduced cost.

According to the present invention, a coin intermittent accepting device of a reservation type coin acceptor including a coin reserving passage for temporarily reserving a plurality of coin, an acceptance gate provided at a lower outlet end of the reserving passage and a retractable coin stop located at the upstream side of the outlet end, comprises an electromagnetic solenoid fixed on one of two parallelly spaced side plates of said coin reserving passage, parallelly spaced support arms each having one end pivotably supported on a pivot axis extending perpendicular to the longitudinal axis of a plunger of the electromagnetic solenoid and other free end integral with the acceptance gate, and a coin stop arm having one end pivotably supported on the pivot axis and other free end providing the coin stop, at least one of the support arms and the coin stop arm being provided with longitudinal slots inclined in opposite directions, respectively, and the plunger of the electromagnetic solenoid having at the free end thereof an actuating pin extending perpendicular to the longitudinal axis of the plunger and engaging the inclined slots.

In a preferred embodiment, the side plate of the coin reserving passage may be formed with an opening through which the acceptance gate is extruded into the reserving passage and the coin stop is withdrawn out of the reserving passage, respectively and inverse when the electromagnetic solenoid dienergized to extend the plunger and is energized to retract the plunger.

The inclined slots formed in the acceptance gate supporting arm and the coin stop arm are inclined in the opposite directions, respectively, such that the acceptance gate is withdrawn out of the reserving passage, simultaneously the coin stop is extruded into the reserving passage when the plunger of the electromagnetic solenoid is retracted.

DESCRIPTION OF THE PREFERRED EMBODIMENT

The present invention will be described in more detail in the following with reference to the accompanying drawings illustrating a preferred embodiment of the coin intermittent accepting device according to the present invention.

Figure 1:
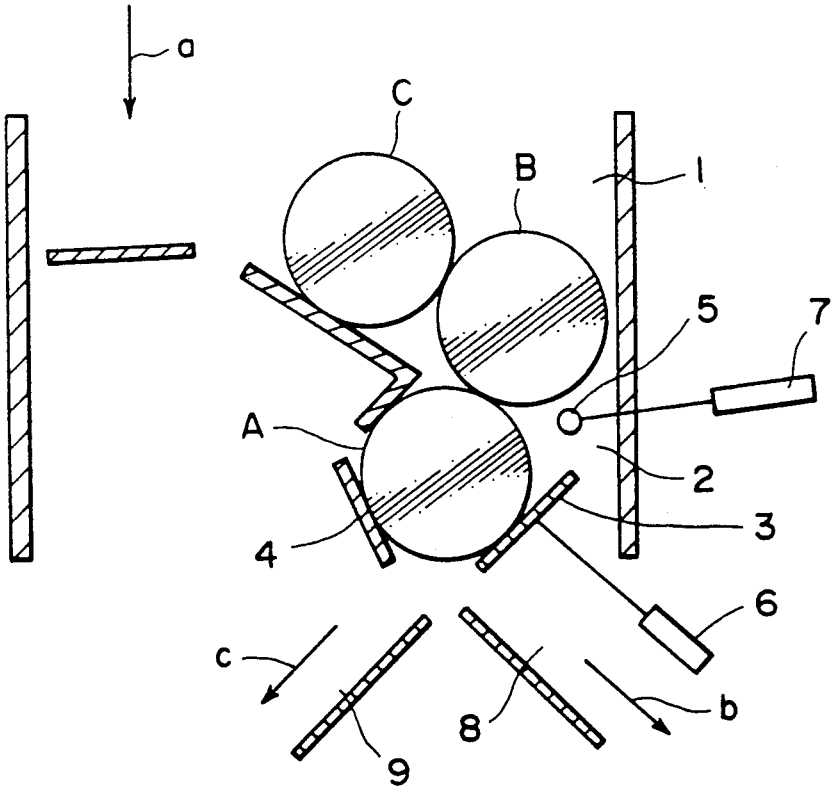
F I G . 1 PRIOR ART
FIG. 1 is a diagrammatic view showing a conventional reservation type coin acceptor.
Figure 2:
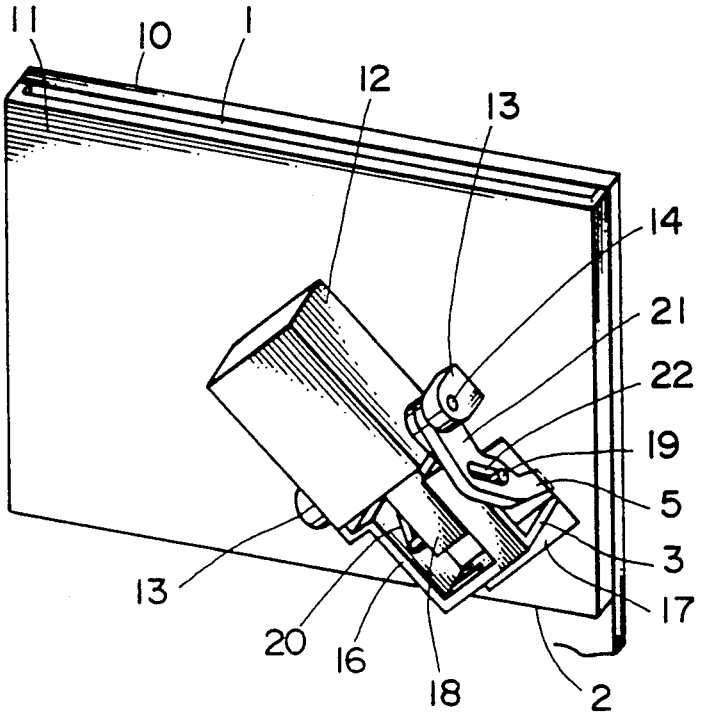
FIG. 2 is a schematic perspective view illustrating an embodiment of the coin intermittent accepting device of the present invention.
Figure 3:
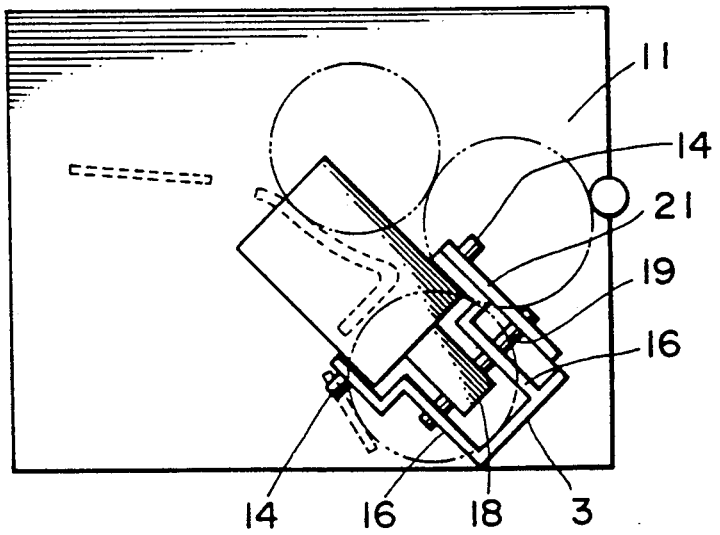
FIG. 3 is a side elevation of FIG. 2.

Referring to FIG. 2, the coin intermittent accepting device according to the present invention is fixed on one of parallelly spaced side plates 10 and 11 which define a coin reserving passage. To this end, in the embodiment, an electromagnetic solenoid 12 is fixed on the side plate 11 by means of bolts or the like, and brackets 13 are fixed on the side plate 11 at the opposite sides of the electromagnetic solenoid 12. The brackets 13 supports pivot shafts 14 on an axis perpendicular to the longitudinal axis of a plunger 18 of the electromagnetic solenoid 12.

Two parallelly spaced plate shaped support arms 16 are pivotably supported at each one ends thereof on the pivot shaft 14 extending perpendicular to the longitudinal axis of an actuator rod 18 of the electromagnetic and other free ends of the support arms 16 are integrally formed with the acceptance gate 3. A coin stop arm 21 is pivotably supported on the pivot axis at one end thereof, and other free end provides the coin stop 5. The side plate 11 of the coin reserving passage 1 may be formed with an opening 17 through which the acceptance gate 3 can be protruded into the reserving passage 1 at a predetermined position of the outlet end 2 and the coin stop 5 can be protruded at a predetermined position upstream of the outlet end 2. The support arms 16 and the coin stop arm 21 are provided with longitudinal slots 20 and 22 inclined in opposite directions, respectively, and the acturator rod 18 of the electromagnetic solenoid is provided at the free end thereof with an actuating pin 19 which is extended perpendicular to the longitudinal axis of the actuator rod 18 so as to engage the inclined slots 20 and 22.

Figure 4:
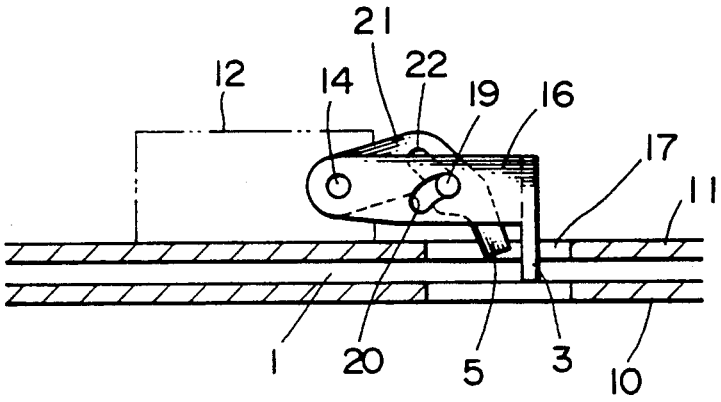
FIGS. 4 and 5 illustrating different actuated positions of the acceptance gate and coin stop.
Figure 5:
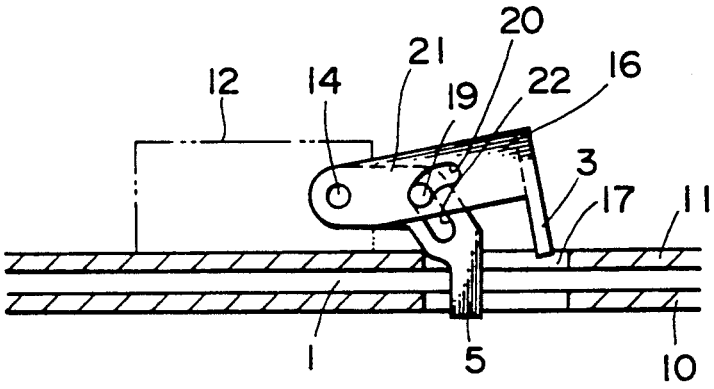

The inclined slots 20 and 22 formed in the acceptance gate supporting arm 16 and the coin stop arm 21 are inclined in the opposite directions, respectively, such that when the electromagnetic solenoid 12 is energized to retract the plunger 18 against a returning spring (not shown), the acceptance gate 3 is witdrawn out of the reserving passage 1 after the coin stop 5 has been completely extruded into the reserving passage 1 as shown in FIG. 5. While, when the electromagnetic solenoid 12 is dienergized to extend the plunger 18 by the returning spring, the coin stop 5 is withdrawn out of the reserving passage 1 to pass the reserved coin into the outlet end 32 after the acceptance gate 3 has been closed as shown in FIG. 4.

According to the aforementioned arrangement, when the electromagnetic solenoid 12 is usually dienergized, the acceptance gate 3 is extruded into the reserving passage 1 through the opening 17 in the side plate 11 of the reserving passage 1 to close the outlet end 2, while the coin stop 5 is retracted form the reserving passage 1 as shown in FIG. 4.

Under such a condition shown in FIG. 4, when the electromagnetic solenoid 12 is energized by a control signal from a timer or the like to retract the plunger 18 having the actuating pin 19 in engagement with the inclined slots 20 and 22 in the acceptance gate supporting arm 16 and the coin stop arm 21. Thus, the acceptance gate supporting arm 16 is rotated about the pivot axis 14 away from the side wall 11 to thereby withdrawn the acceptance gate 3 through the opening 17 out of the reserving passage 1, simultaneously the coin stop arm 21 is rotated about the pivot axis 14 toward the side wall 11 to thereby extrude the coin stop 5 into the reserving passage 1, as shown in FIG. 5 since the inclined slot 20 in the acceptance gate supporting arm 16 is upwardly inclined from the side of pivot axis 14 (FIG. 4), while the inclined slot 22 is the coin stop arm 21 is inclined in the opposite direction, i.e. downwardly inclined from the side of pivot axis 14 (FIG. 5).

Therefore, it is seen from FIG. 4 that after the acceptance gate 3 has been closed, the coin stop 5 is withdrawn out the reserving passage to permit the reserved coin to pass into the outlet end of the reserving passage 1 and also it is seen from FIG. 5 that when the acceptance gate 3 is opened to pass the reserved coin to the acceptance passage, the coin stop 5 has been sufficiently extruded in the reserving passage 1 to prevent following reserved coin from passing into the acceptance passage 8 through the outlet end of the reserving passage 1.

What is claimed is:

1. A coin intermittent accepting device including a coin reserving passage for temporarily reserving a plurality of coins, an acceptance gate provided at a lower outlet end of the reserving passage, a retractable coin stop located at the upstream side of the outlet end, an electromagnetic solenoid fixed on one of parallelly spaced side plates of said of said coin reserving passage, at least one support arm having one end pivotably supported on a pivot axis exending perpendicular to the longitudinal axis of a plunger of the electromagnetic solenoid and the other end integral with the acceptance gate, and a coin stop arm having one end pivotably supported on the pivot axis and the other free end providing the coin stop, the support arm and the coin stop arm being provided with longitudinal slots inclined in opposite directions, respectively, and the plunger of the electromagnetic solenoid having at the free end thereof an actuating pin extending perpendicular to the longitudinal axis of the plunger and engaging the inclined slots.

2. The device claimed in claim 1, wherein said one side plate of the coin reserving passage being provided with an opening through which the acceptance gate is extruded into the reserving passage and the coin stop is withdraw out of the reserving passage.

3. The device claimed in claim 1, wherein the inclined slots formed in the acceptance gate supporting arm and the coin stop arm being inclined in the opposite directions such that the acceptance gate is withdrawn out of the reserving passage, simultaneously the coin stop is extruded into the reserving passage when the plunger of the electromagnetic solenoid is retracted.

* * * * *